US006210495B1

(12) United States Patent
Legrand et al.

(10) Patent No.: US 6,210,495 B1
(45) Date of Patent: Apr. 3, 2001

(54) METHOD FOR PREPARING A RARE EARTH- AND TRANSITION METAL-BASED MAGNETICALLY ANISOTROPIC MATERIAL BY SOLIDIFYING A LIQUID ALLOY IN A GUIDING FIELD

(75) Inventors: Beatrice Legrand, Fontaine; Rene Perrier de la Bathie, St. Pierre D'Albigny; Robert Tournier, Bilieu, all of (FR)

(73) Assignee: Centre National de la Recherche Scientifique, Paris (FR)

( * ) Notice: Subject to any disclaimer, the term of this patent is extended or adjusted under 35 U.S.C. 154(b) by 0 days.

(21) Appl. No.: 09/180,274

(22) PCT Filed: May 6, 1997

(86) PCT No.: PCT/FR97/00814

§ 371 Date: Nov. 6, 1998

§ 102(e) Date: Nov. 6, 1998

(87) PCT Pub. No.: WO97/42640

PCT Pub. Date: Nov. 13, 1997

(30) Foreign Application Priority Data

May 6, 1996 (FR) ..... 96 05879

(51) Int. Cl.[7] ..... H01F 1/053; H01F 1/055
(52) U.S. Cl. ..... 148/301; 147/103
(58) Field of Search ..... 148/103, 108, 148/301, 303; 164/147.1, 48, 498

(56) References Cited

U.S. PATENT DOCUMENTS

| | | | | |
|---|---|---|---|---|
| 3,956,031 | * | 5/1976 | Marcus | 148/103 |
| 4,836,867 | * | 6/1989 | Sugawara et al. | 148/301 |
| 4,913,745 | * | 4/1990 | Sato | 148/103 |
| 4,957,549 | * | 9/1990 | Matsumoto et al. | 148/301 |
| 4,969,961 | * | 11/1990 | Pinkerton et al. | 148/301 |
| 5,168,096 | | 12/1992 | Tournier . | |
| 5,456,769 | * | 10/1995 | Sakurada et al. | 148/301 |

FOREIGN PATENT DOCUMENTS

| | | | |
|---|---|---|---|
| 2 660 107 | * | 9/1991 | (FR) . |
| 1330791 | | 9/1973 | (GB) . |

OTHER PUBLICATIONS

IEEE Transactions on Magnets, Heng–Zhi Fu et al, vol. 25, No. 5, Sep. 1, 1989, pp. 3797–3799, CP000069221 "The Studies of Directional Solidified Re–Co Magnets".

* cited by examiner

*Primary Examiner*—John Sheehan
(74) *Attorney, Agent, or Firm*—Dennison, Scheiner, Schultz & Wakeman

(57) ABSTRACT

Method for obtaining a solid, magnetically anisotropic material, includes the steps of heating an alloy containing a rare earth element and at least one transition metal to a temperature higher than the melting temperature of the alloy and sufficient that alloy is completely liquid, and cooling the melted alloy at a rate at least equal to natural cooling in the presence of a continuous, static magnetic field to solidify the alloy and obtain the magnetically isotropic material.

12 Claims, No Drawings

METHOD FOR PREPARING A RARE EARTH- AND TRANSITION METAL-BASED MAGNETICALLY ANISOTROPIC MATERIAL BY SOLIDIFYING A LIQUID ALLOY IN A GUIDING FIELD

FIELD OF THE INVENTION

The present invention relates to a process for obtaining magnetically anisotropic materials, in particular for permanent magnets, by solidifying a liquid alloy in an orienting field. This process applies to the production of alloys or magnets containing rare earth elements and transition metals, and more particularly to magnets of samarium-cobalt type.

DESCRIPTION OF RELATED ART

From patent FR 2660107 a process is known for obtaining a magnetic material having a directional metallurgical structure, consisting of using a liquid alloy, bringing said alloy to a temperature such that a composition containing crystallites is obtained, submitting this composition to a magnetic field producing sedimentation during its cooling, in such manner as to obtain a temperature gradient in the sedimentation zone.

It is learnt from this document therefore that solidification must be conducted both in a magnetic field while controlling solidification by slow cooling, and by applying a heat gradient in such manner as to orient grain growth in a preferential direction.

The product obtained has a microstructure which comprises grains whose growth was made in the direction of the heat gradient, these grains simultaneously having magnetocrystalline anisotropy that is usually oriented parallel to the direction of the magnetic field applied during solidification.

In general, such process cannot go further than producing magnetically anisotropic monocrystals having a grain size, in the case of samarium-cobalt based alloys for example, that is greater than 500 $\mu$m; this is a major disadvantage since magnets containing such grains have, in particular, insufficient coercivity.

Also, the implementation of said process comes up against considerable practical difficulties. It requires the simultaneous use of an orienting field and of a complete system allowing rigorous control over slow cooling (20°/h) during solidification in order to obtain the heat gradient in the desired direction.

The process is in fact little productive and difficult to industrialize. In particular, the fact that the initial composition requires the presence of crystallites and the use of slow, controlled cooling, means that it is unsuitable for directly obtaining magnets or cast or moulded products from a liquid metal.

With this type of casting or moulding process, the liquid is usually superheated to avoid undue setting (no crystallites are present therefore) and undergoes fast, uncontrolled cooling and solidification speeds.

Patent application EP 474566 similarly describes a process for preparing a polycrystalline magnetic body of R BaCuO type (R being a rare earth element), consisting of preparing a composition such that in its molten state it comprises crystallites of said body, of heating to a few degrees above melting point so that some crystallites remain, cooling slowly until solidification and applying an orienting magnetic field at least as from the time when the composition starts becoming liquid and up until its solidification.

Such processes therefore entail real operating difficulties requiring the presence of crystallites and the use of slow and/or controlled cooling, and can only achieve products which, even though they have good remanence (Br), have insufficient coercivity (Hcj), in particular for magnets of samarium-cobalt type.

In the face of these difficulties, a more industrial process has been researched for obtaining magnetically textured materials, that is productive, easy to implement and, at the same time, can improve the magnetic characteristics of the products obtained.

SUMMARY OF THE INVENTION

The invention is a process for obtaining a solid, magnetically anisotropic material from an alloy containing a rare earth element and a transition metal that is fully liquid at a temperature significantly higher than its melting point, optionally cast or moulded to obtain a shaped part, which is solidified by natural or forced, non-controlled cooling in the presence of a continuous, static magnetic field.

The process of the invention may be completed after cooling by a magnetic hardening heat treatment stage, comparable to that customarily used for the production of magnets by powder metallurgy (PM).

The magnetic material obtained usually has a remanent magnetization over saturation magnetization ratio Br/Bs of at least 80%.

Also, with the process of the invention it is generally possible to obtain a material having a coercivity (Hcj) at least equal to, and even greater than, that obtained with a material of the same composition produced by PM. For material of samarium-transition metal type, coercivity is at least 8 kOe and typically at least 25 kOe.

With this process it is possible, easily and economically by simple melting-solidification under usual conditions, to obtain a polycrystalline magnetic material or magnets of any shape by simple casting or moulding under economical, industrial conditions.

Under these conditions, the temperature of the initial liquid alloy may largely exceed the melting point of the alloy, for example by at least 10° C., even 150° C., since the presence of crystallite (or seed) subsisting in the liquid is not necessary, and cooling is conducted with no particular control over rate or heat gradient, at speeds that are in general of at least 100° C./sec.

The static magnetic field is generally greater than 2T.

It appears unusual that under such operating conditions, in particular the fast cooling rate, it is possible to obtain an improved magnetically anisotropic material, in particular in the case of samarium-cobalt; even higher speeds, for example of at least 500° C./s, may even be used to improve the metallurgical quality of the parts obtained without jeopardizing their magnetic quality.

Indead according to the prior art, the use of a slow cooling speed at the time of solidification is justified by the fact that the grains (crystallites) must be given the opportunity to appear and have the time to orient themselves under the action of the field. Also, the presence of crystallites is justified since, if they are not present during solidification, germination may occur simultaneously at all points of the liquid and too quickly for grain orientation to take place. The presence of a heat gradient in a given direction also contributes to promoting grain growth in preferential direction and to promoting texturing of the solid magnetic material.

For men of the art, therefore, slow, controlled cooling and the presence of pre-existing crystallites appear essential in order to obtain a textured material. In opposition to this conclusion, the present invention shows that this is not the case, in particular for Sm—Co based materials for which the action of the orienting field alone is sufficient to obtain an anisotropic (textured) material regardless of cooling conditions; it is possible that this unexpected texturing result may be due to another phenomenon.

The microstructure of the solid obtained is generally homogeneous, containing grains whose average size is less than 500 μm, which are magnetically anisotropic through crystallographic orientation produced by the applied orienting magnetic field.

The initial liquid alloy preferably has the composition of the solid material it is desired to obtain, in order to avoid having to collect and remove a supernatant liquid, from which one of the components of the alloy has been removed, during solidification. The superheated liquid alloy can be cast in a mould in which solidification can take place by natural or forced, non-controlled cooling in a magnetic field.

The process of the invention advantageously applies to the production of magnetic materials containing samarium and a transition metal (M) (such as cobalt, iron, copper, zirconium) preferably having the atomic composition Sm $(Co,Cu,Fe,Zr)_x$, where x varies between 5 and 9, in particular alloys of $Sm_2M_{17}$ or $SmM_5$ type.

The structure of these materials can be orientated by applying an orienting magnetic field of sufficient intensity regardless of superheating or cooling conditions, as already mentioned, but this is not the case for other magnetic compounds such as superconductor ceramics of R Ba Cu O type, which require slow cooling without undergoing any significant prior superheating.

The invention also relates to the magnetic material and the corresponding magnets obtained by complete melting of an initial alloy, optionally cast in a mould to obtain a part of desired shape, followed by natural or forced solidification in a continuous static magnetic field.

The magnets may be cast and solidified directly in their final shape, which shape may be very varied and complex; said shape is only limited by casting techniques, since cooling is conducted using usual techniques. The process is particularly economical and suitable for the production of full ring-shaped magnets (toric shape) or partial ring shapes (tulles, half-circles . . . ) etc.

Therefore the magnets obtained have magnetic characteristics equivalent to those of magnets obtained by powder metallurgy (PM), whereas they may have much more complex shapes, their production is industrial and more economical and they offer improved mechanical characteristics.

DETAILED DESCRIPTION OF THE INVENTION

The following examples give an illustration of the invention.

EXAMPLE 1

This example illustrates a process of the prior art, of the type described in Example 2 of document FR 2660107 cited above.

A liquid alloy containing crystallites, whose composition corresponds to the atomic formula Sm Co 5.01 Cu 0.67 Fe 2.5 Zr 0.17 was obtained at 1270° C. in a small, cylindrically shaped crucible having an inner diameter of 20 mm and a height of 20 mm.

It was subjected to controlled cooling at the rate of 20° C./h in the heating chamber while a magnetic field of 5T was applied along the axis of the crucible using a superconductor magnet. Solidification time was 4 h.

After complete cooling, magnetic hardening heat treatment was conducted during an initial annealing process at 1150° C. for 10 h, followed by tempering, and second annealing at 810° C. for 10 h with slower cooling at 10° C./h.

The sample cylinder obtained had an anisotropic crystalline magnetic structure oriented parallel to the direction of the field. Its structure contained grains whose size ranged from 600 to 2000 μm, and its coercivity (Hcj) remained below 2 kOe despite magnetic hardening heat treatment.

EXAMPLE 2

This example illustrates the invention.

The same alloy as in Example 1 was brought to a temperature in the region of 1420° C.; the completely liquid alloy obtained was subsequently cast in a crucible of cylindrical ring shape placed in the axis of a superconductor magnet producing a field of 5T. The average diameter of the ring was 24 mm and its thickness 6 mm.

Cooling was conducted using argon circulation cooling took place at an average speed of 600° C./min and solidification was complete after 30 sec.

In another test, using natural convection cooling, the speed was 50° C./min and complete solidification was obtained after 5 min.

On account of its ringed shape, the alloy was subjected, during cooling and solidification, to heat gradients whose direction and intensity could not be controlled.

After complete cooling, the toric-shaped part was removed from the mould and subjected to magnetic hardening heat treatment similar to that in Example 1. After magnetization, the results obtained were grouped under Table 1 and compared with the values for a magnet obtained by PM having the same composition and of cylinder shape.

TABLE I

| | | According to the invention | | |
|---|---|---|---|---|
| | | Forced cooling under argon | Natural convection | PM |
| Remanent Magnetiation Br | kG | 11.5 | 11.5 | 11 |
| Orientation Br/Bs | | 90% | 90% | 90% |
| Coercivity Hcj | kOe | 28 | 25 | 28 |
| Average size of crystallites | μm | 100 | 200 | 50 |
| Operating time | | 0.5 h | 1 h | 5 h |

It is to be noted that ring-shaped magnets cannot generally be produced by PM.

This table shows that the magnets of the invention have a remanence that is equivalent, and even better than, those of magnets obtained under the prior art, for example in Example 1 or by PM.

Their coercivity is significantly greater, regardless of cooling mode, than that of the magnet in Example 1 and reaches that of magnets produced by PM.

Their mechanical strength is too as well higher.

Therefore, the process of the invention, as already mentioned, leads to a textured magnetic material, with grain orientation in a preferential direction, having a finer microstructure than that of materials of the prior art melted and solidified in a field, but the process advantageously enables a material to be obtained having isotropy of its mechanical properties unlike said materials of the prior art.

What is claimed is:

1. Method for obtaining a solid, magnetically anisotropic material, comprising the steps of:

heating an alloy containing a rare earth element and at least one transition metal to a temperature higher than the melting temperature of the alloy and sufficient that the alloy is completely liquid; and cooling the melted alloy at a rate at least equal to natural cooling in the presence of a continuous, static magnetic field to solidify the alloy and obtain the magnetically anisotropic material.

2. Method according to claim 1, additionally comprising casting or molding the liquid alloy to obtain a shaped part after cooling.

3. Method according to claim 1, wherein the cooling rate is greater than 100° C./s.

4. Method according to claim 1, wherein the cooling rate is at least 50° C./s.

5. Method according to claim 1, wherein the magnetic field is greater than 2T.

6. Method according to claim 1, wherein the alloy contains samarium and at least one transition metal selected from the group consisting of Co, Fe, Cu and Zr.

7. Method according to claim 6, wherein the alloy has a formula $Sm(Co, Fe, Cu, Zr)_x$, where x is from 5 to 9.

8. Anisotropic magnetic material having a microstructure of magnetically oriented crystallites of average size less than 500 $\mu$m and a coercivity (Hcj) of at least 25 kOe, obtained by steps comprising:

heating an alloy containing a rare earth element and at least one transition metal to a temperature higher than the melting temperature of the alloy and sufficient that alloy is completely liquid; and cooling the melted alloy at a rate at least equal to natural cooling in the presence of a continuous, static magnetic field to solidify the alloy and obtain the magnetically isotropic material.

9. Material according to claim 8, wherein the alloy contains samarium and at least one transition metal selected from the group consisting of Co, Fe, Cu and Zr.

10. Material according to claim 8, having a coercivity (Hcj) greater than 25 kOe.

11. Material according to claim 8, in a cast or molded shape.

12. Material according to claim 11, in a full or partial ring shape.

* * * * *